US009410090B2

(12) United States Patent
Sawai et al.

(10) Patent No.: US 9,410,090 B2
(45) Date of Patent: Aug. 9, 2016

(54) METHOD OF OPERATING CRUDE TREATMENT SYSTEM

(71) Applicant: JGC Corporation, Tokyo (JP)

(72) Inventors: Naoaki Sawai, Kanagawa (JP); Yoshihiro Mizuguchi, Kanagawa (JP)

(73) Assignee: JGC Corporation, Tokyo (JP)

( * ) Notice: Subject to any disclaimer, the term of this patent is extended or adjusted under 35 U.S.C. 154(b) by 227 days.

(21) Appl. No.: 14/224,280

(22) Filed: Mar. 25, 2014

(65) Prior Publication Data

US 2015/0275100 A1 Oct. 1, 2015

Related U.S. Application Data

(63) Continuation of application No. 12/927,901, filed on Nov. 29, 2010, now abandoned.

(51) Int. Cl.

| | |
|---|---|
| ***C10G 7/00*** | (2006.01) |
| ***C10G 11/18*** | (2006.01) |
| *C10G 7/06* | (2006.01) |
| *B01D 3/00* | (2006.01) |

(52) U.S. Cl.
CPC ..... *C10G 11/18* (2013.01)

(58) Field of Classification Search
CPC ..... C10G 7/00; C10G 7/06; B01D 3/00
See application file for complete search history.

(56) References Cited

U.S. PATENT DOCUMENTS

| | | | | |
|---|---|---|---|---|
| 3,303,127 | A * | 2/1967 | Potts et al. | 208/355 |
| 3,617,494 | A * | 11/1971 | Montgomery | 208/80 |
| 4,576,709 | A * | 3/1986 | Miller et al. | 208/57 |
| 4,814,088 | A * | 3/1989 | Kutowy et al. | 210/651 |
| 2005/0006279 | A1 | 1/2005 | Gueret et al. | |
| 2005/0284796 | A1 | 12/2005 | Benham | |
| 2011/0168524 | A1 | 7/2011 | Sawai et al. | |

(Continued)

FOREIGN PATENT DOCUMENTS

| | | |
|---|---|---|
| EP | 2 354 212 | 8/2011 |
| JP | 2003-277770 | 10/2003 |
| JP | 5-421793 | 2/2014 |

OTHER PUBLICATIONS

Derungs W A: "Naphthenic Acid Corrosion an Old Enemy of The Pretroleum Industry", Corrosion, NACE International, US, vol. 12, No. 2, Jan. 1, 1956, pp. 41-46, XP009144971, ISSN: 0010-9312 *abstract* .

(Continued)

*Primary Examiner* — Brian McCaig
(74) *Attorney, Agent, or Firm* — Jordan and Koda PLLC

(57) ABSTRACT

Crude containing a comparatively large content of nickel, vanadium, or carbon residue is treated so as to supply a raw material to a downstream catalytic cracking process. A primary distillation tower fractionates first crude into a residue fraction partly used as raw oil of a catalytic cracking process and other fractions. A secondary distillation tower fractionates second crude containing a larger content of a catalytic poison with respect to catalysts used in the catalytic cracking process than the first crude into a light fraction included in a distillation temperature range of the other fractions and a heavy fraction as a rest thereof. A light fraction supply line supplies the light fraction to the primary distillation tower so as to be treated in the primary distillation tower.

10 Claims, 2 Drawing Sheets

(56) References Cited

U.S. PATENT DOCUMENTS

2012/0261312 A1* 10/2012 Flores Oropeza et al. .... 208/188
2013/0206642 A1* 8/2013 Zhao et al. ..... 208/14

OTHER PUBLICATIONS

Jayaraman A et al: "Naphthenic Acid Corrosion in Petroleum Refineries, A Review", Oil & Gas Science and Technology—Revue De L'Institut Francaisdu Petrole, Editions Technip, Paris, FR, vol. 41, No. 2, Mar. 1, 1986, pp. 265-274, XP009144952, ISSN: 0020-2274, DOI: DOI: 10.2516/OGST: 1986016 *abstract* .

O'Connor P et al: "Challenges, catalyst technology and catalytic solutions in resid FCC" Catalysis Today, Elsevier, NL, vol. 43, No. 3-4, Jan. 1, 1998, pp. 305-313, XP009145240, ISSN: 0920-5861 *abstract* .

* cited by examiner

METHOD OF OPERATING CRUDE TREATMENT SYSTEM

TECHNICAL FIELD

The present invention relates to a technology of treating crude containing a catalytic poison with respect to a catalyst of a catalytic cracking process.

BACKGROUND ART

In recent years, a demand for a heavy crude treatment increases due to an increase in demand for crude, an increase in cost, and a limitation in production. Meanwhile, properties of heavy crude have a large influence on a downstream unit for treating various fractions fractionated from a crude distillation unit (CDU) as a primary unit.

For example, a carbon residue (hereinafter, a carbon residue specified in Conradson (JIS K2270-1) is referred to as a CCR (Conradson Carbon Residue)), vanadium (V), or nickel (Ni) abundantly contained in heavy crude causes an increase in the yield of cokes or offgas or a degradation of catalytic activity in a catalytic cracking process using a residue fluid catalytic cracking unit (hereinafter, referred to as a RFCCU) for cracking atmospheric residue (hereinafter, referred to as AR) as a residue fraction obtained from the CDU through a contact with a catalyst.

In the pasty catalytic poisons such as V and Ni contained in the AR obtained from the heavy crude were removed by a pretreatment unit such as heavy oil direct-desulfurization unit (hereinafter, referred to as a RDSU), but in many cases, refineries for mainly treating light crude were not provided with the RDSU. However, since the RDSU is one of the expensive units of the petroleum refinery, from the economic viewpoint, it is difficult to construct the RDSU for producing a heavy product from crude.

Here, PTL 1 discloses a technology which allows the atmospheric residue fractionated from the CDU to contact with subcritical water or supercritical water added with oxidizer so as to isolate vanadium from the atmospheric residue, and removes the vanadium through capture agent formed by iron or activated carbon. However, in the technology disclosed in PTL 1, a condition of a high temperature and a high pressure is required because the subcritical water or supercritical water is used, and a cost involved with the unit or operation increases because the oxidizer or capture agent is consumed. Meanwhile, there is no description for a technology of removing nickel or CCR from the atmospheric residue, and there still remains a problem in that the activity of the catalyst used in the catalytic cracking process is degraded.

CITATION LIST

Patent Literature

[PTL 1] JP-A-2003-277770: claims 1 and 8 and FIG. 1

SUMMARY OF INVENTION

Technical Problem

The present invention comes from the consideration of such circumstances, and an object of the invention is to provide a crude treatment system which treats crude containing a comparatively large content of nickel, vanadium, or carbon residue, and supplies raw materials to a downstream catalytic cracking process.

Solution to Problem

A crude treatment system according to the invention includes: a primary distillation tower which fractionates first crude supplied from a first crude supply line into a residue fraction partly or entirely used as raw oil of a catalytic cracking process and other fractions; a secondary distillation tower which fractionates second crude supplied from a second crude supply line and containing a larger content of a catalytic poison with respect to catalysts used in the catalytic cracking process than the first crude into a light fraction included in a distillation temperature range of the other fractions and a heavy fraction as a rest thereof; and a light, fraction supply line which supplies the light fraction to the primary distillation tower so as to be treated.

In addition, a crude treatment system according to another invention includes: a primary distillation tower which fractionates first crude supplied from a first crude supply line into a residue fraction partly or entirely used as raw oil of a catalytic cracking process and other fractions; a secondary distillation tower which fractionates second crude supplied from a second crude supply line and containing a larger content of a catalytic poison with respect to catalysts used in the catalytic cracking process than the first crude into a light fraction having a content of the poison equal to or less than a predetermined value and a heavy fraction as a rest thereof; and a light fraction supply line which supplies the light, fraction to the primary distillation tower so as to be treated.

Further, the crude treatment system may have the following characteristics.

(a) There are provided a vacuum distillation tower which distills the heavy fraction in a vacuum condition so as to obtain a vacuum gas oil fraction used as raw oil of the catalytic cracking process and other vacuum residue fractions; and a heavy fraction supply line which supplies the heavy fraction from, the secondary distillation tower to the vacuum distillation tower so as to treated.

(b) There is provided a residue fraction supply line which supplies the residue fractions to the vacuum distillation tower so as to be treated.

(c) The residue fraction fractionated from the primary distillation tower is mixed with the vacuum gas oil fraction fractionated from the vacuum distillation tower so as to be used as raw oil of the catalytic cracking process.

(d) The catalytic poison is selected from a catalytic poison group consisted of nickel, vanadium, or carbon residue.

(e) The second crude includes crude selected, from a crude group consisted of Mayan crude, Orinoco tar, and oil sand/bitumen.

Advantageous Effects of Invention

According to the first invention, since there is provided the secondary distillation tower capable of treating the second crude having a large content of the catalytic poison with respect to the catalysts used in the catalytic cracking process, and the light fraction having a temperature range not mixed with the residue fraction supplied to the catalytic cracking process is extracted from the second crude, even when the light fraction is supplied to the primary distillation tower for treating the first crude having a small content of the catalytic poison, it is possible to suppress an increase in the content of the catalytic poison contained in the residue fraction fractionated from the primary distillation tower.

According to the second invention, since there is provided the secondary distillation tower capable of treating the second crude having a large content of the catalytic poison with respect, to the catalysts used in the catalytic cracking process, and only the light fraction having a small content of the catalytic poison is extracted from the second crude, even when the light fraction is supplied to the primary distillation tower for treating the first crude having a small content of the catalytic poison, it is possible to suppress an increase in the content of the catalytic poison contained in the residue fraction fractionated from the primary distillation tower.

As a result, in any one of the first invention and the second invention, since it is possible to produce a heavy product from the crude without having an influence on the downstream catalytic cracking process, there is a wide choice of crude which can be created in the crude treatment system.

DESCRIPTION OF EMBODIMENTS

Hereinafter, a crude treatment system will be described which treats crude containing a comparatively large content of catalytic poisons such as CCR, V, and Ni and supplies raw materials to, for example, RFCCU.

Figure 1:
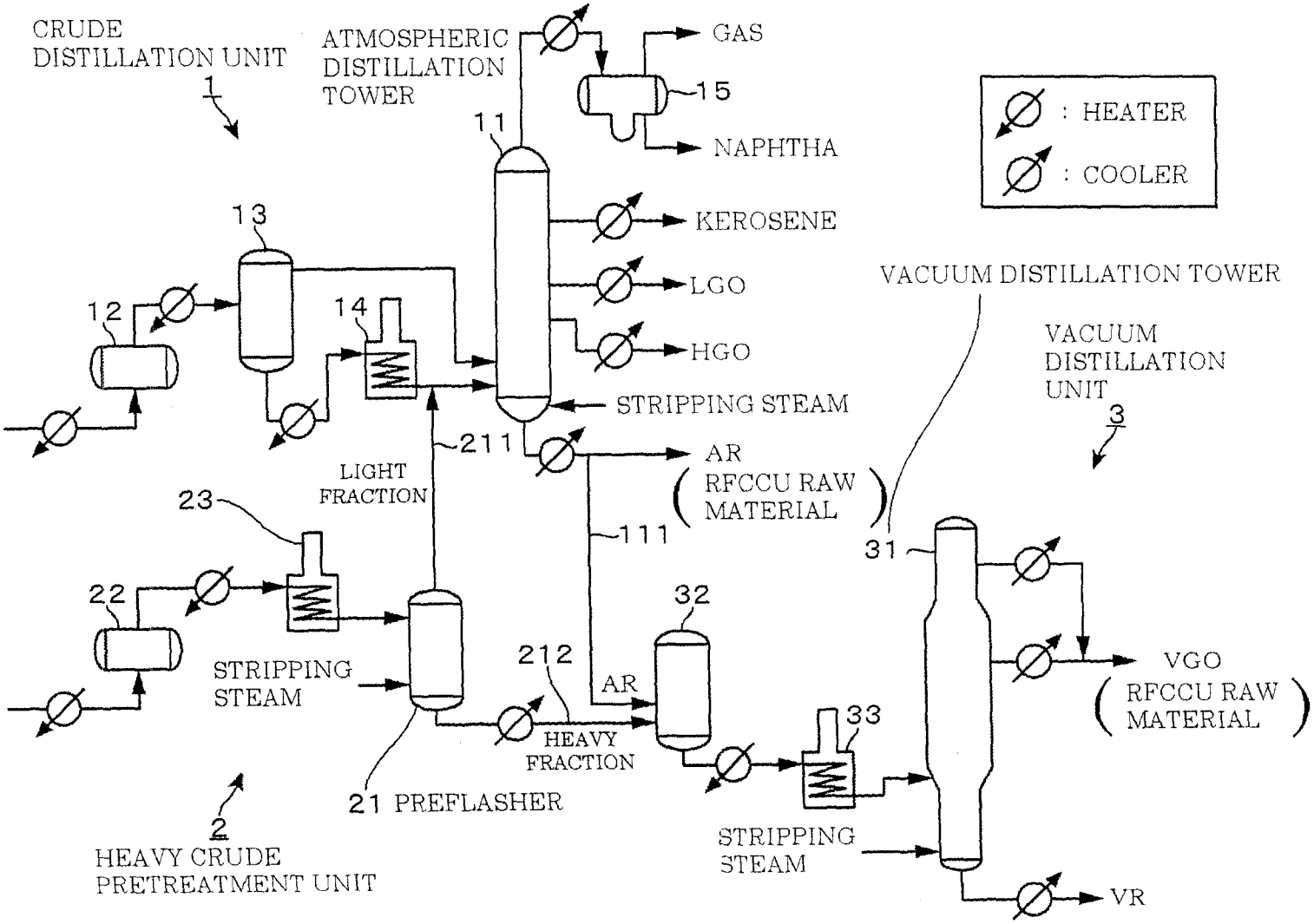
FIG. 1 is an explanatory diagram showing a configuration of a crude treatment system according to an embodiment.

FIG. 1 is an explanatory diagram showing a configuration of a crude treatment system according to the embodiment. The crude treatment system includes, for example, a crude distillation unit 1 which distills light crude containing a small content of CCR, V, and Ni in an atmospheric pressure state, a vacuum distillation unit 3 which distills AR fractionated from the crude distillation unit 1 in a vacuum condition, and a heavy crude pretreatment unit 2 which pretreats heavy crude having a comparatively large content of CCR, V, and Ni so as to send a fraction, not causing a degradation of a catalyst in a downstream catalytic cracking process even when the fraction is treated in the crude distillation unit 1, to the crude distillation unit 1 and to send a fraction having a large content of a catalytic poison to the vacuum distillation unit 3. In the embodiment to be described later, the "content of catalytic poison" indicates, for example, the content per unit mass, that is, the density based on the mass of crude or AR.

The crude distillation unit 1 is, for example, a unit, which obtains various interim products by distilling light crude having a small content, of CCR, V, and Ni in an atmospheric pressure state. The corresponding crude directly supplied to the crude distillation unit 1 corresponds to first crude according to the embodiment.

The crude distillation unit 1 has, for example, a configuration in which a desalter 12, a preflash drum 13, a heating furnace 14, and an atmospheric distillation tower 11 are connected to each other in this order from the upstream side. The desalter 12 performs a function (desalting function) of removing free water or salt contained in the received crude, and the preflash drum 13 divides the desalted crude into, for example, a light fraction such as a naphtha fraction and a heavy fraction heavier than the naphtha fraction so as to directly supply the light fraction to the atmospheric distillation tower 11 and to supply the heavy fraction to the downstream heating furnace 14. The heating furnace 14 heats the heavy fraction supplied from the preflash drum 13, for example, at a temperature equal to or more than 300° C. and equal to or less than 380° C., and supplies the heated heavy fraction to the atmospheric distillation tower 11.

The pipes connecting the units 12, 13, and 14 to each other are provided with a heater such as a heat exchanger group so as to preheat the crude or the heavy fraction to be supplied to the preflash drum 13 or the heating furnace 14 up to a predetermined temperature. A series of unit groups including the desalter 12, the preflash drum 13, the heating furnace 14, and the pipes connecting them to each other correspond to a first crude supply line according to the embodiment.

The atmospheric distillation tower 11 is a primary distillation tower which distills the light fraction received from the preflash drum 13 and the heavy fraction received from the heating furnace 14 in an atmospheric pressure state so as to obtain an overhead gas and fractions of AR, heavy gas oil (hereinafter, referred to as HGO), light gas oil (hereinafter, referred to as LGO), kerosene, and naphtha, and is configured as, for example, a known tray-type distillation tower. Here, in contrast to AR as a residue fraction of the invention, the overhead gas, the naphtha, the kerosene, the LGO, and the HGO correspond to the "other fractions" of the invention.

The bottom portion of the atmospheric distillation tower 11 is connected to a pipe which supplies stripping steam for separating the light fraction of oil, and the head portion thereof is provided with a receiver 15 which cools the overhead gas so as to obtain the overhead gas and naphtha. In addition, the atmospheric distillation tower 11 is provided with a reflux line which improves the sharpness of separation or a side stripper which separates the light fraction of the kerosene, the LGO, and HGO extracted, from the atmospheric distillation tower 11 by using steam, but they are not shown in the drawing for convenience of description. The fractions of the HGO, the LGO, the kerosene, and the naphtha fractionated from the atmospheric pressure tower 11 and cooled by a cooler are sent to the downstream treatment unit such as a desulfurization unit. Meanwhile, a part of the AR as the residue fraction, of the embodiment extracted from the bottom portion of the tower is sent to the downstream RFCCU so as to be subjected to a catalytic cracking process using a catalyst, and the rest of the AR is sent to the downstream vacuum distillation unit 3 through an AR transfer pipe 111 (residue fraction supply line) so as to be distilled in a vacuum condition.

The vacuum distillation unit 3 has, for example, a configuration in which a surge drum 32, a heating furnace 33, and a vacuum distillation tower 31 are connected to each other in this order from the upstream side. The surge drum 32 temporarily stores the AR or the like received from the atmospheric distillation tower 11, and discharges the stored AR or the like to the heating furnace 33. The heating furnace 33 heats the vacuum distillation raw material supplied from the surge drum 32, for example, at a temperature equal to or more than 380° C. and equal to or less than 420° C.

The vacuum distillation tower 31 distills the raw oil received from the heating furnace 33, for example, in the vacuum condition equal to or more than 1.33 kPa and equal to or less than 13.3 kPa (equal to or more than 10 mmHG and equal to or less than 100 mmHg) so as to obtain vacuum residue (hereinafter, referred to as VR) and vacuum gas oil (hereinafter, referred to as VGO) which can be obtained by the mixture with the fraction fractionated from the middle stage portion and the head portion of the vacuum distillation tower 31, and is configured as, for example, a tray-type distillation tower.

As in the above-described atmospheric distillation tower 11, the bottom portion of the vacuum distillation tower 31 is connected to a pipe which supplies stripping steam for the separation of the light fraction of the oil. In addition, it is characterized in that the VR which can be obtained from the bottom portion of the tower is used as, for example, raw materials of heavy oil bases, cokes, or asphalts, and the VGO is used as raw materials of the RFCCU as in the AR of the crude distillation unit 1, but the detail thereof will be described later.

The above-described crude treatment system is provided with a heavy crude pretreatment unit 2 which obtains RFCCU raw materials by treating heavy crude having a comparatively large content of, for example, CCR, V, and Ni. Hereinafter, the detail of the heavy crude pretreatment unit 2 will be described.

Figure 2:
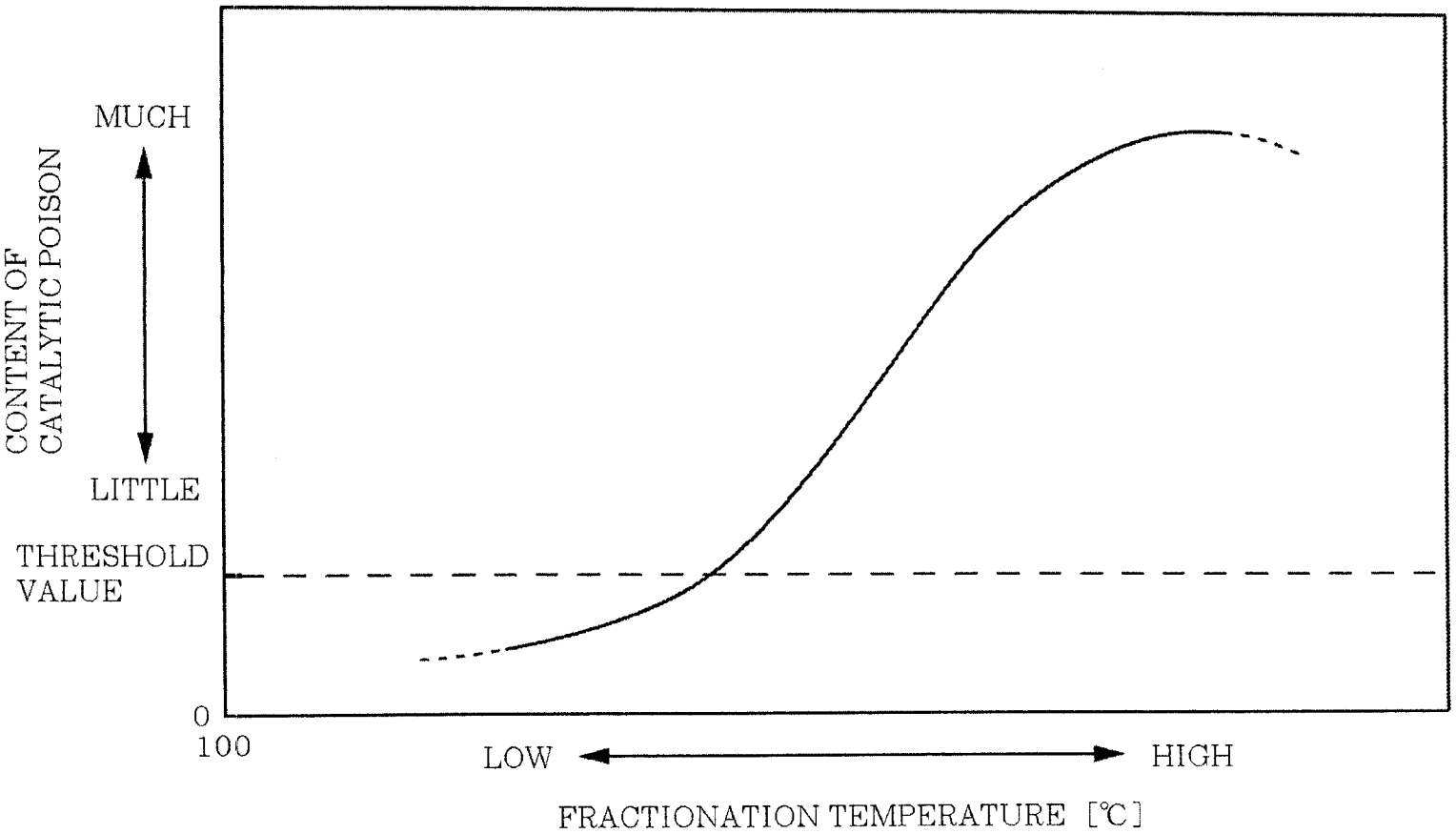
FIG. 2 is a characteristic diagram showing an example of a variation in content of a catalytic poison with respect to a fractionation temperature of heavy crude.

For example, as schematically shown in FIG. 2, heavy crude called extra-heavy crude such as Mayan crude, Orinoco tar, and oil sand/bitumen contains a large content of a catalytic poison (CCR, V, and Ni) as much as the heavy fraction having a high fractionation temperature. Here, for example, when only the light fraction (the light fraction includes the HGO, and the same applies hereinafter) having a fractionation temperature lighter than that of the HGO is separated from the heavy crude and is supplied to the atmospheric distillation tower 11, most of the light, fraction is not mixed with the AR, and flows out from the atmospheric distillation tower 11 as the fraction lighter than the HGO. As a result, it is possible to treat a part of the heavy crude in the crude distillation unit 1 without increasing the content of the catalytic poison of the RFCCU in the AR. The heavy crude pretreatment unit 2 according to the embodiment has such a configuration, and the heavy crude supplied to the heavy crude pretreatment unit 2 corresponds to second crude according to the embodiment.

The heavy crude pretreatment unit 2 has, for example, a configuration in which a desalter 22 which desalts salt or the like contained in heavy crude, a heating furnace 23 which heats the desalted heavy crude at a temperature equal to or more than 200° C. and equal to or less than 370° C., and a preflasher 21 are connected to each other in this order from the upstream side. A series of units including the desalter 22, the heating furnace 23, and the pipe connecting them to each other correspond to a second crude supply line according to the embodiment.

The preflasher 21 is a distillation tower which fractionates the heavy crude received from the heating furnace 23 into, for example, a light fraction lighter than the HGO and a heavy fraction heavier than the light fraction. The preflasher 21 is not limited to a particular type, but may be a tray-type distillation tower. For example, a flash-distillation-type distillation tower may be used. In addition, a temperature condition and a pressure condition are not limited to a particular range of condition, but may be set so as to obtain the light fraction and the heavy fraction at a target temperature. The preflasher 21 corresponds to a secondary distillation tower according to the embodiment, and fractionates the heavy crude into the light fraction included in the fractionation temperature range of the "other fractions" of the invention, and the residual heavy fraction.

The light fraction fractionated from the preflasher 2 and being lighter than, for example, the HGO is supplied to, for example, the atmospheric distillation tower 11 of the crude distillation unit 1 through a light fraction supply pipe 211. Here, in accordance with the sharpness of separation between the light fraction and the heavy fraction in the preflasher 2, a part of the heavy fraction may be mixed with the light fraction and may be supplied to the atmospheric distillation tower 11. Here, for example, the mixture amount of the catalytic poison in the AR may be decreased in such a manner that an allowance is set so that 90% of the fractionation temperature of the light fraction is lower by, for example, 10° C. than 90% of the fractionation temperature of the HGO fractionated from the atmospheric distillation tower. The above-described light fraction supply pipe 211 and the pipe merged with the light fraction supply pipe 211 and supplying the light fraction to the atmospheric distillation tower 11 correspond to a light fraction supply line according to the embodiment.

Meanwhile, the heavy fraction as the rest of the light fraction extracted from the preflasher 21 has a distillation property corresponding to, for example, the AR. The heavy fraction is supplied to, for example, the surge drum 32 of the vacuum distillation unit 3 through the heavy fraction supply pipe 212, and is distilled in the vacuum distillation tower 31 in a vacuum condition together with the AR fractionated from the atmospheric distillation tower 11. Here, since the heavy fraction fractionated from the preflasher 21 contains a large content of CCR, V, and Ni as the catalytic poisons, the vacuum distillation raw material mixed with the AR supplied from the surge drum 32 to the vacuum distillation tower 31 contains a larger content of the catalytic poisons than the AR fractionated from the atmospheric distillation tower 11.

Meanwhile, as shown in FIG. 2, even the vacuum distillation raw material has a characteristic in which the heavy side contains a large content of the catalytic poison, and the light side contains a small content thereof. Here, in the vacuum distillation tower 31, for example, the VGO and the VR are fractionated in a fractionation temperature in which all the contents of the CCR, V, and Ni are equal to or less than a predetermined value. The VGO having a small content of the catalytic poison and obtained in this manner is mixed with a part of the AR fractionated from, for example, the atmospheric distillation tower 11, and is supplied to the downstream RFCCU. In addition, the VR containing a large content of the catalytic poison is used as, for example, raw materials of heavy oil bases, cokes, or asphalts. The heavy fraction supply pipe 212, the surge arum 32, the heating furnace 33, and the pipes connecting them to each other correspond to a heavy fraction supply line.

Each of the setting values of the CCR, V, and Ni is appropriately set in accordance with, for example, a variation in mixture ratio between the AR and VGO. However, it is desirable that the content of the catalytic poison contained in the raw oil (in the example, synthetic oil of the AR and VGO) of the RFCCU is substantially equal, to that of the AR obtained when only the first crude as the light crude is treated in, for example, the crude distillation unit 1. Here, since the detailed content of the V, Ni, and CCR in the raw oil as the RFCC largely changes in accordance with the catalyst or the capacity of the RFCC, it is difficult to exemplify the detailed value. However, for example, 90% of the fractionation temperature of the VGO is set so as to satisfy the standard (target value) of the CCR or the content of the V and Ni in the raw oil set in the RFCC.

Likewise, since the VGO fractionated from the vacuum distillation tower 31 is diluted by the AR fractionated from, the atmospheric distillation tower 11, and is supplied to the RFCCU, the setting value of each of the catalytic poisons changes in accordance with the content of the catalytic poisons in the AR or the dilution rate by the AR. At this time, when the content of the catalytic poison in the VGO is equal to or less than the setting value of the total VGO in calculation, the treatment in the RFCCU may be performed, and the fraction of the VR may be mixed with the VGO in accordance with the sharpness of separation between the VGO and VR. Here, in the vacuum, distillation tower 31 according to the embodiment, since the content of the catalytic poison in the fraction in 90% of the fractionation temperature of the VGO is set to be equal to or less than the setting value, for example, even when about 10% of the VR is mixed with the VGO, the content of the catalytic poison as the RFCC raw material does not exceed the predetermined target value. In addition, at this time, an allowance may be set so that 90% of the fractionation temperature of the VGO is lower than the theoretical temperature by, for example, about 10° C.

In addition, the raw material supply pipes of the crude distillation unit 1, the heavy crude pretreatment unit 2, and the vacuum distillation unit 3, the supply pipe of the interim product, or the fuel supply pipes of the heating furnaces 14, 23, and 33 are provided with control terminals such as a flow rate control valve, thereby forming a DCS (Distributed Control System) for controlling the entire crude treatment system through the control terminals. Accordingly, for example, it is possible to control the fractionation temperature range of each of the light fraction, the heavy fraction, or the interim products.

Then, for example, the AR fractionated from the atmospheric distillation tower 11 is periodically sampled, and the distillation property, the content of V and Ni, or the CCR is measured. Then, for example, when the value of the CCR and the content of the V or Ni in the AR is equal to or more than a predetermined value, it indicates that the heavy crude supplied to, for example, the heavy crude pretreatment unit 2 further becomes heavy, and the V, Ni, or CCR carried into the atmospheric distillation tower 11 by the light fraction increases. Here, in this case, when the fuel supply amount to the heating furnace 23 is decreased, the temperature of the heavy crude supplied to the preflasher 21 is decreased, and then the V, Hi, and CCR contained in the light, fraction is decreased, it is possible to decrease the amount of the poisoned components in the AR directly supplied to the RFCCU. In addition, of course, a feedback control may be performed in which the distillation property of the AR, the content of the V and Ni, and the CCR is analyzed on-line, and the temperature of the heavy crude of the outlet of the heating furnace 23 is controlled on the basis of the detection value of the on-line analysis system.

When the heavy crude is supplied to the heavy crude pretreatment unit 2 having the above-described configuration, the temperature of the heavy crude is increased up to a predetermined temperature through the desalter 22 and the heating furnace 23, and the heavy crude is separated into the light fraction lighter than the HGO and having a small content of the catalytic poison and the residual heavy fraction in the inside of the preflasher 21. Then, since the light fraction separated in the preflasher 21 is distilled in the atmospheric distillation tower 11 so as to be fractionated as the fractions lighter than the HGO, most, of the catalytic poisons carried by the heavy crude is not mixed with the AR.

Here, in fact, a case may be supposed in which a minute amount of the catalytic poison carried by the heavy crude is mixed with the AR in accordance with the sharpness of separation between the HGO and AR and the sharpness of separation between the light fraction and the heavy fraction in the preflasher 21. However, a part of the AR is distilled by the vacuum distillation unit 3 in a vacuum condition so as to be separated as the VGO having a small content of the catalytic poison. The residual AR is mixed with the VGO so that the content of the catalytic poison is equal to or less than the target value, and is considered as the raw oil of the RFCC. Accordingly, there is low possibility that the catalytic activity of the RFCCU is degraded.

In addition, at this time, the distillation property, the content of the V and Ni, or the CCR of the AR fractionated from the atmospheric distillation tower 11 is periodically monitored. In addition, for example, when the CCR and the content of the V and Ni in the AR exceed a predetermined value due to the reason such as a variation in property of the heavy crude, the temperature of the outlet of the heating furnace 23 of the heavy crude pretreatment unit 2 is decreased, and the fraction having a comparatively high fractionation temperature in the light fraction having much CCR due to the large content of the V and Ni is transferred to the heavy fraction. Accordingly, it is possible to decrease the content of the catalytic poisons in the AR directly supplied to the RFCCU by decreasing the content of the catalytic poisons in the light fraction supplied to the atmospheric distillation tower 11.

Meanwhile, the heavy fraction fractionated from the bottom portion of the tower of the preflasher 21 is supplied to the vacuum distillation unit 3 so as to be distilled in the vacuum distillation tower 31 in a vacuum condition together with a part of the AR supplied from the crude distillation unit 1 and to be fractionated into the VGO having a small content of the catalytic poisons and the residual VR, and the VGO is mixed with the residual AR so as to be supplied to the RFCCU. At this time, as described above, for example, 90% of the fractionation temperature of the VGO is set so that the content of the catalytic poisons in the raw oil of the RFCC is equal to or less than a target value. Then, in the example, since the target value is set so that the content of the catalytic poison is equal to that of the AR obtained when only the first crude as the light crude is treated in, for example, the crude distillation unit 1, it is possible to suppress a degree of a degradation of the catalytic activity in the RFCCU as in the past.

In the crude treatment system according to the embodiment, there is a following advantage. Since there is provided the pre flasher 21 capable of treating the heavy crude (second crude) having a large content of the catalytic poisons (CCR, V, and Ni) with respect to the catalyst used in the RFCCU, and only the light fraction lighter than the HGO not mixed with the AR is extracted from the heavy crude, even when the light fraction is supplied to the atmospheric distillation tower 11 for treating the light crude (first crude) having a small content of the catalytic poison, it is possible to suppress an increase in the content of the catalytic poison contained in the residue fraction fractionated from the atmospheric distillation tower 11. As a result, since it is possible to produce a heavy product from the crude without having an influence on the downstream RFCCU, there is a wide choice of crude which can be treated, in the crude treatment system.

Particularly, the heavy crude pretreatment unit 2 for fractionating the heavy crude into two fractions (the light fraction and the heavy fraction) has a comparatively simple unit configuration, and the construction cost of the unit can be suppressed compared with, for example, the case where a RDSU or a metal removing tower for removing the V or Ni in the FCCRU raw material is constructed in association with the RDSU. In addition, for example, in the case where a heavy product is produced from the treatment crude by the existing crude distillation unit 1, in the crude treatment system according to the example, after the heavy crude pretreatment unit 2 or the vacuum, distillation unit 3 is constructed in, for example, adjacent regions while continuing the operation of the crude distillation unit 1, and the constructed units may be connected to the crude distillation unit 1, thereby contributing to a reduction in the opportunity loss by suppressing the stop time of the crude distillation unit 1 to be short.

Here, in the above-described preflasher 21, a case is described in which the heavy crude is fractionated into the light fraction as the fraction lighter than the HGO and the residual heavy fraction, but the principle of the fractionation between the light fraction and the heavy fraction is not limited to the example. For example, in the characteristic of the fractionation temperature and the content of the catalytic poison shown in FIG. 2, the light fraction may be selected as the fraction having a content of the catalytic poison in 90% of the fractionation temperature of the light fraction, for example, the fractionation temperature range in which the content is equal to that of the AR obtained when only the first crude as the light crude is treated by the crude distillation unit 1.

In this case, for example, in the case where the fraction heavier than the HGO is contained in the light fraction, the fraction is mixed with the AR. However, since the content of the catalytic poison in the fraction is smaller than that of the AR obtained when only the light crude is treated, the content of the catalytic poison in the AR is not increased. Even in the case of the example, in consideration of the case where a part of the heavy fraction is mixed with the light fraction in accordance with the sharpness of separation between the light fraction and the heavy fraction, for example, an allowance may be set so that the temperature lower by 10° C. than 90% of the fractionation temperature of the setting value is used as 90% of the fractionation temperature of the light fraction.

Further, the supply ratio between the light crude (first crude) supplied to the crude distillation unit 1 and the heavy crude (second crude) supplied to the heavy crude pretreatment unit 2 is appropriately set in accordance with, for example, the size of the atmospheric distillation tower 11 or the preflasher 21 or the operable supply amount range. However, the invention is not limited to the case where the crude is supplied in parallel from both lines. For example, in the state where the supply of the crude from one crude supply line is stopped so that the crude is circulated in the one crude supply line, the operation may be performed by using the crude supplied only from the other crude supply line.

In addition, the invention is not limited to the case where the target value of the content of the catalytic poison in the raw oil of the RFCC is within the limited range of the property of the raw oil of the RFCCU. For example, the degree of the degradation of the catalyst of the RCCU may be further suppressed by setting the target value to a low value. On the contrary, the yield of the VGO, that is, the yield of the raw oil of the RFCCU may be increased by setting the target value to a high value. In this case, for example, when the amount of the catalyst input to the RFCCU is increased, the activity corresponding to the degradation of the catalyst is compensated.

In addition, in the crude treatment system according to the invention, the vacuum distillation tower 31 capable of treating the heavy fraction in a vacuum condition may not be essentially provided. The heavy fraction extracted from the preflasher 21 may be directly used as raw materials of heavy oil bases, cokes, or asphalts, or the heavy fraction may be transferred to, for example, another refinery including the RDSU so as to be treated. At this time, a total amount of the AR fractionated from the atmospheric distillation tower 11 is used as raw oil of the RFCCU.

Further, in the example, as the catalytic poisons of the RFCC catalyst, the CCR, V, and Ni contained in the crude are mainly described, but the type of the catalytic poison contained in the crude which can be treated by the invention is not limited thereto. For example, as shown in FIG. 2, if the catalytic poison is contained in the light fraction by a small content, only the fraction not mixed with the AR may be extracted as the light fraction or only the fraction having a small content of the catalytic poison may be extracted as the light fraction so as to be treated in the atmospheric distillation tower 11. Further, only the VGO having a small content of the catalyst in the heavy fraction may be extracted so as to be used as the FCCU raw material.

In addition, the catalytic cracking process capable of supplying a raw material through the crude treatment system according to the invention is not limited to the RFCC. For example, the invention may be applied to the FCC process which desulfurizes the VGO, obtained by treating a total amount of the AR fractionated from the atmospheric distillation tower 11 in the vacuum distillation tower 31, in an indirect desulfurization unit (HDSU), and performs the catalytic cracking process thereon. Even in this case, for example, 90% of a fractionation temperature of the VGO may be set so that the content of the CCR, V, and Ni contained in the raw oil supplied to the HDSU is equal to or less than a predetermined value, and the content of the catalytic poisons in, for example, the desulfurized vacuum gas oil fractionated from the distillation tower of the HDSU may be equal to or less than that of the case where only the light crude is treated.

REFERENCE SIGNS LIST

1: CRUDE DISTILLATION UNIT
11: ATMOSPHERIC DISTILLATION TOWER
2: HEAVY CRUDE PRETREATMENT UNIT
21: PREFLASHER
211: LIGHT FRACTION SUPPLY PIPE
212: HEAVY FRACTION SUPPLY PIPE
3: VACUUM DISTILLATION UNIT
31: VACUUM DISTILLATION TOWER

The invention claimed is:

1. A method for operating a crude treatment system comprising:

supplying first crude from a supply line to a primary distillation tower;

fractionating the first crude by the primary distillation tower into a residue fraction and other fractions, the residue fraction being partly or entirely used as raw oil of a catalytic cracking process;

supplying second crude containing a larger content of a catalytic poison with respect to catalysts used in the catalytic cracking process than the first crude from a second crude supply line to a secondary distillation tower;

fractionating the second crude by the secondary distillation tower into a light fraction and a heavy fraction as a rest thereof, the light fraction having a distillation temperature range within a distillation temperature range of the other fractions fractionated in the primary distillation tower;

supplying the light fraction from a light fraction supply line to the primary distillation tower so as to be treated; and wherein the second crude includes crude selected from a crude group consisting of Mayan crude, Orinoco tar, and oil sand/bitumen.

2. The method of operating the crude treatment system according to claim 1, further comprising:

supplying the heavy fraction from the secondary distillation tower via a heavy fraction supply line to the vacuum distillation tower so as to be treated; and distilling the heavy fraction in a vacuum condition by a vacuum distillation tower so as to obtain a vacuum gas oil fraction used as raw oil of the catalytic cracking process and other vacuum residue fractions.

3. The method of operating he crude treatment system according to claim 2, further comprising: supplying the residue fraction from the primary distillation tower to the vacuum distillation tower via a residue fraction supply line.

4. The method of operating the crude treatment system according to claim 2, further comprising mixing the residue fraction fractionated from the primary distillation tower with the vacuum gas oil fraction fractionated from the vacuum distillation tower so as to be used as raw oil of the catalytic cracking process.

5. The method of operating the crude treatment system according to claim 1, wherein the catalytic poison is selected from a catalytic poison group consisted of nickel, vanadium, and carbon residue.

6. A method for operating a crude treatment system comprising:

supplying first crude from a supply line to a primary distillation tower;

fractionating the first crude by the primary distillation tower into a residue fraction and other fractions, the residue fraction being partly or entirely used as raw oil of a catalytic cracking process;

supplying second crude containing a larger content of a catalytic poison with respect to catalysts used in the catalytic cracking process than the first crude from a second crude supply line to a secondary distillation tower;

fractionating the second crude by the secondary distillation tower into a light fraction and a heavy fraction as a rest thereof, the light fraction having a content of the poison equal to or less than a predetermined value;

supplying the light fraction from a light fraction supply line to the primary distillation tower so as to be treated; and wherein the second crude includes crude selected from a crude group consisting of Mayan crude, Orinoco tar, and oil sand/bitumen.

7. The method of operating the crude treatment system according to claim 6, further comprising:

supplying the heavy fraction from the secondary distillation tower via a heavy fraction supply line to the vacuum distillation tower so as to be treated; and distilling the heavy fraction in a vacuum condition by a vacuum distillation tower so as to obtain a vacuum gas oil fraction used as raw oil of the catalytic cracking process and other vacuum residue fractions.

8. The method of operating the crude treatment system according to claim 7, further comprising: supplying the residue fraction from the primary distillation tower to the vacuum distillation tower via a residue fraction supply line.

9. The method of operating the crude treatment system according to claim 7, further comprising mixing the residue fraction fractionated from the primary distillation tower with the vacuum gas oil fraction fractionated from the vacuum distillation tower so as to be used as raw oil of the catalytic cracking process.

10. The method of operating the crude treatment system according to claim 6, wherein the catalytic poison is selected from a catalytic poison group consisting of nickel, vanadium, and carbon residue.

* * * * *